US005899096A

United States Patent [19]

Sangiacomo

[11] Patent Number: 5,899,096

[45] Date of Patent: May 4, 1999

[54] DEVICE FOR NEEDLE-BY-NEEDLE SELECTION IN CIRCULAR STOCKING KNITTING MACHINES

[75] Inventor: Fulvio Sangiacomo, Brescia, Italy

[73] Assignee: Sangiacomo S.p.A., Brescia, Italy

[21] Appl. No.: 09/049,954

[22] Filed: Mar. 27, 1998

[51] Int. Cl.[6] ..... D04B 15/78

[52] U.S. Cl. ..... 66/221; 66/220; 66/219

[58] Field of Search ..... 66/221, 220, 219

[56] References Cited

U.S. PATENT DOCUMENTS

| | | | |
|---|---|---|---|
| 5,165,259 | 11/1992 | Negri et al. | 66/219 |
| 5,197,303 | 3/1993 | Aria | 66/217 |
| 5,205,139 | 4/1993 | Aria | 66/221 |
| 5,361,608 | 11/1994 | Salucci et al. | 66/220 |

*Primary Examiner*—Andy Falik
*Attorney, Agent, or Firm*—McGlew and Tuttle

[57] ABSTRACT

A device for needle-by-needle selection in circular stocking knitting machines is disclosed. An elastic lock pin or segment (19) is provided for each lower needle (13) of the type having an elastic deflection tail. The segment is carried by a crown (22) fixed with the cylinder and usually in a position shifted downwards away from the tail of the lower needle. A thruster (20) is provided under the lock segment, which can be moved upwards and is intended to deflect the lock segment (19) up to the level of interception with the tail of the lower needle (13). This results in a locking of the lower needle in the deflected, inoperative position. A selection electromagnet (21) is provided which can be activated and deactivated according to a program to hold or release the lock segment. The activation/deactivation keeps the inoperative lower needle locked or releases it because it is moved towards the outside into the operating position.

6 Claims, 2 Drawing Sheets

DEVICE FOR NEEDLE-BY-NEEDLE SELECTION IN CIRCULAR STOCKING KNITTING MACHINES

FIELD OF THE INVENTION

The present invention pertains in general to circular stocking/sock knitting machines and knitting machines and refers in particular to a device for needle-by-needle selection in said machines with the use of elastic lower needles and electromagnets operated electronically.

BACKGROUND OF THE INVENTION

Systems for selecting needles using electromagnets as selection actuators have already been proposed in the field of stocking knitting machines. These electromagnets cooperate, by means of mechanical elements, with the deflected lower needles in order to control their passage from a deflected, inoperative position to a released, operating position, in which they can control the corresponding needles.

A circular knitting machine is disclosed in U.S. Pat. No. 5,165,259 to Negri et al. In this device the inactivation or activation of a vertical jack below each needle is determined by a flexible fork located radially above the cylinder within a ring structure completely surrounding the machine cylinder and rigid therewith. A number of forks and radial grooves equal to the number of needles is provided. The forks are able to flex within the grooves and are selected by magnetic force. The jacks are kept in position by one or more circular springs surrounding the upper part of the jacks. The springs must be sufficiently shrunk to oppose the forces which flex the jack shank, so that the flexing forces acting on the foot effect the flexture without causing the upper end of the jack to leave the trick.

SUMMARY AND OBJECTS OF THE INVENTION

The primary object of the present invention is to provide an original, simple selection device of the type mentioned above, which does not have any moving springs and masses, to reduce the inertias and to make it possible for the circular machine, to which it is applied, to operate without problems even at high speeds.

According to the invention, a device for a needle-by-needle selection in circular stocking knitting machines is provided, comprising a cylinder with longitudinal grooves. A needle and a lower needle are mounted in each groove for raising the needle. Each lower needle has a said lowering heel and a raising heel interacting with lowering and raising cams of the lower needle. Each lower needle has an elastic rod, which moves radially due to mechanical deflection towards the bottom of the groove into an inoperative position, in which the lower needle remains inoperative, and the raising heel thereof does not interact with the raising cam and, due to its own elasticity, towards the outside of the said groove into an operating position, in which the said raising heel thereof interacts with the raising cam, and in which the deflection of the lower needle is applied at the level of the said raising heel thereof. The lower needle ends at the bottom with a tail. A selector means is arranged at a level of the tail of the lower needle and includes an elastic lock pin or segment, carried by a crown fixed with the cylinder, oriented radially from the outside towards the tail of the lower needle and positioned to be usually maintained in a position shifted downwards away from the said tail. The selector means also includes a thruster arranged vertically under the lock segment, which can be moved upwards by means of raising and lowering cams and is intended to lock the lower needle in the deflected, inoperative position when it rises to deflect the lock segment up to the level of interception with the tail. The selector means also includes a selection electromagnet that can be activated and deactivated according to a program. The selection electromagnet is arranged above the lock segment and is intended to hold this segment in the position of interception with the tail of the lower needle, even if the thruster is moved towards the bottom, and to release the lock segment, because it returns downwards due to its own elasticity when the lower needle must be unlocked and moved towards the outside into the operating position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
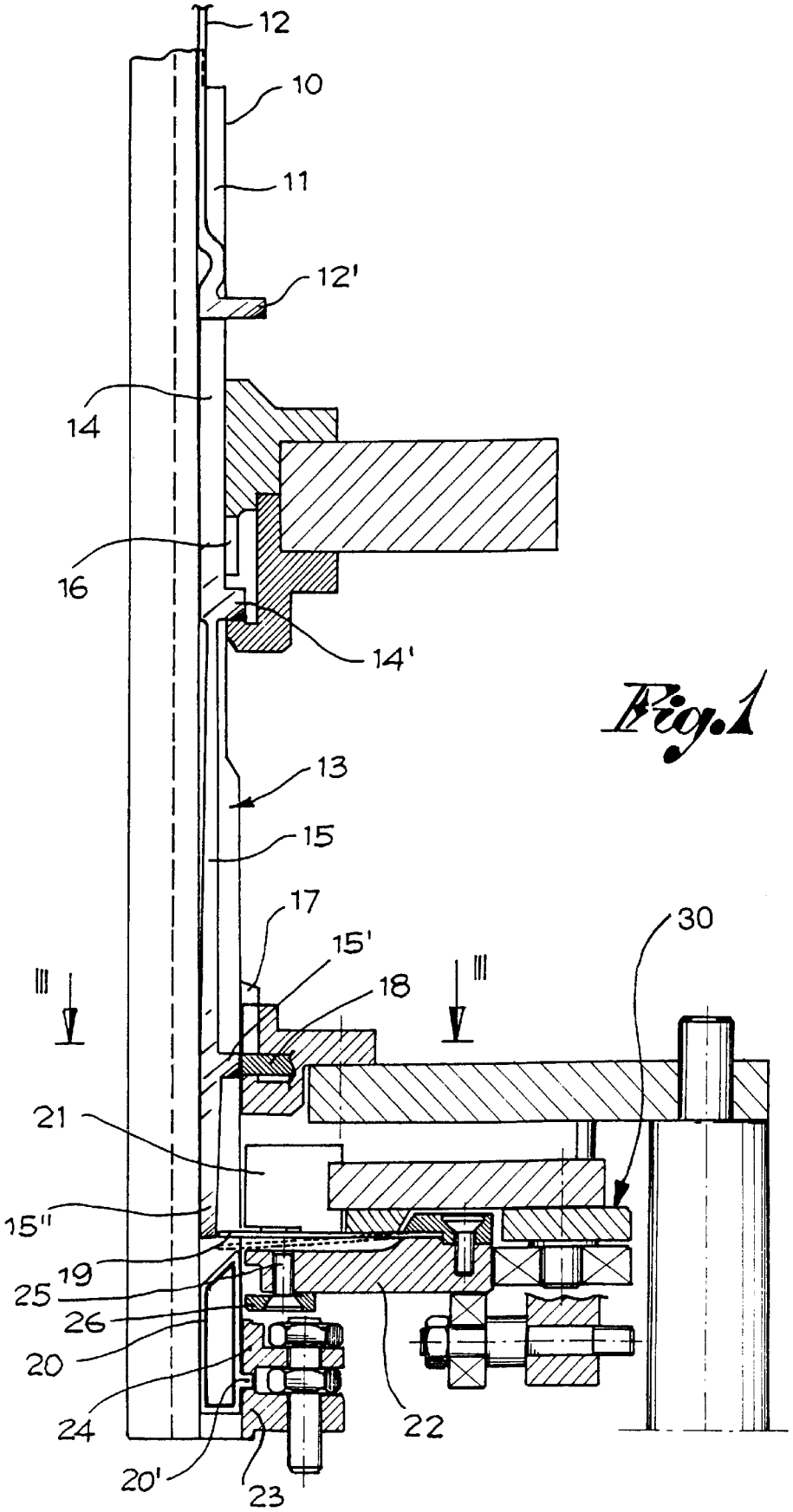
FIG. 1 is a partial sectional view showing part of a circular stocking knitting machine complete with selection device.

Referring to the drawings in particular, the cylinder of a circular machine is indicated by 10, which peripherally has longitudinal grooves 11, in each of which are arranged, aligned and sliding, a needle 12 and, below this, a lower needle or jack 13 for raising the needle.

The needle 12 has a heel 12', which interacts with raising and lowering cams (not shown) arranged around the cylinder.

The lower needle 13 has an upper fixed part 14 with a lowering heel 14', and, for the rest, has an elastic rod 15 having an intermediate raising heel 15' and a lower tail 15". As a whole, the elastic rod 15 of the lower needle 15 moves radially, due to mechanical deflections, towards the bottom of the groove 11 into an inoperative position, in which the lower needle remains inoperative and, due to its own elastic reaction, towards the outside of the groove 11 into an operating position, in which it can control the respective needle 12.

At least one lowering cam 16 and at least one raising cam 17 are provided around the cylinder 10 at the level of the fixed part 14 of the lower needle 13 and at the level of the elastic rod 15, respectively. The lowering cam 16 interacts with the lowering heel 14' in order to lower the lower needle 13 to a lower selection level and correspondingly to make possible the lowering of the needle 12.

The raising cam 17 interacts with the raising heel 15' in order to raise the lower needle 13 and correspondingly the needle 12 when the elastic rod 15 of the lower needle is moved outwards into the operating position.

A fixed deflection cam 18, which, interacting with the heel 15', deflects the elastic rod 15 of the lower needle on the bottom of the groove in the inoperative position, is also provided around the cylinder at the level of the raising heel 15' of the lower needle 13 when this lower needle 13 is completely lowered into the selection position as in the drawing. While it is in this position, the raising heel 15' of the lower needle is not intercepted by the raising cam 17, but passes on the inside of same, so that the lower needle remains in the lowered position.

The inoperative position of each lower needle 13 may also be maintained on the other side of the deflection cam or abandoned for the elastic return of the lower needle into the operating position by means of selector means arranged at the tail 15" of the lower needle.

These selector means comprise, for each lower needle 13 and in accordance with the present invention, an elastic lock segment or pin 19, a thruster 20 and a selection electromagnet 21 fixed with the machine body, which thus does not rotate with the cylinder, arranged to precede each feed station.

The elastic lock segment 19 is carried by a crown 22 fixed to the cylinder by means of screws and plugs 25, 26 and is oriented radially from the outside towards the tail 15" of the lower needle 13.

The elastic segment 19 is arranged in a position shifted downwards away from the tail 15" of the lower needle.

The thruster 20 is arranged vertically below the elastic segment 19 and has a heel 20' interacting with the raising and lowering cams 23 and 24.

When the thruster rises, it makes the elastic segment deflect, carrying it at the level of the tail of the lower needle. In this position, the segment locks the lower needle radially in the deflected, inoperative position and can be maintained in this position or allowed to drop by means of the electromagnets 21.

The elastic segments 19 are preferably flat, numbering the same as the lower needles 13 and balanced angularly with same. They are made of a ferromagnetic material.

The end of the elastic segment 19 is deflected before meeting the electromagnetic selection member 21 by the deflection cam 23 by means of the thruster 20 in order to be carried in proximity or in sliding contact with the electromagnet 21, which, following the activation that is supplied moment by moment, holds the segment 19 deflected or allows it to turn downwards, which is the way shown in broken line.

According to an illustrated embodiment, the electromagnetic selection device 21 is positioned on the outside and above the crown of segments 19 and comprises, in its essential elements, a permanent magnet 21', 21'". The permanent magnet part 21' permanently attracts the ends of the segments 19, which are deflected because of the cam 23 by means of the thruster 20 in contact with same. An electromagnet portion 21" that is interposed and activated with an electromagnet, which is or is not activated in contrast with the action of the permanent magnet portion 21 in such a way as to cancel the magnetism in this position and thus to release the ends of the segments, which are loaded elastically by the cam 23 or to hold them deflected upwards.

Therefore, starting from the condition in which the lower needles are lowered and deflected in the inoperative position and thus maintained in the respective lock position, it is possible to operate their selection by activating or deactivating the electromagnets 21 according to a program.

It should be noted that the segments essentially serve only as a "trigger" and remain fixed on the crown, which rotates together with the cylinder, while the magnet is fixed on the machine body.

In addition, the system (support means) generally designated 30 carrying the lock segments 19 and electromagnets 20 can be constrained with the possibility both of radial adjustment and of height adjustment with the cylinder.

Figure 2:
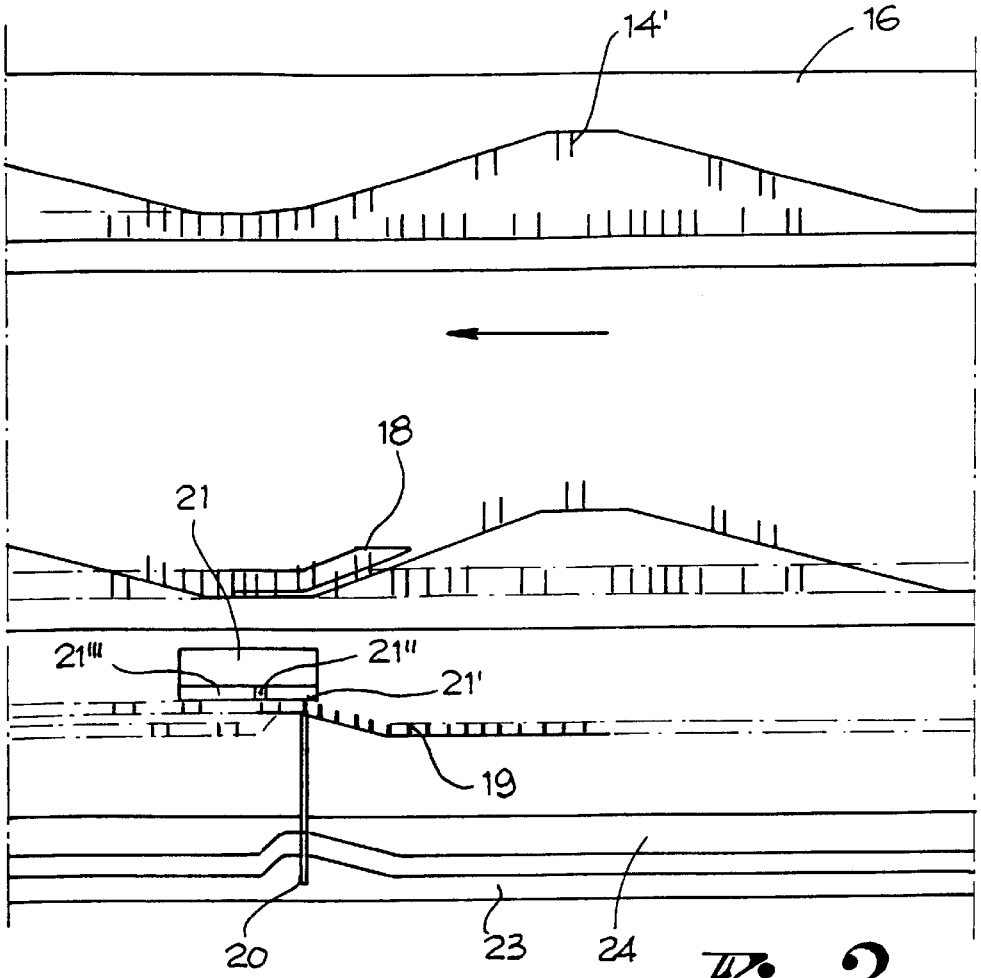
FIG. 2 is a diagram showing the system of cams for raising/lowering the lower needles in relation to the lock segments and to the thrusters.
Figure 3:
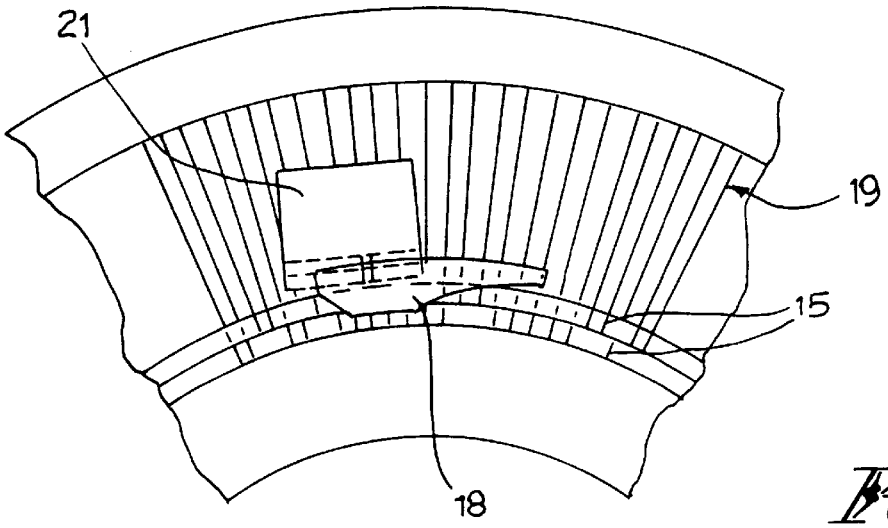
FIG. 3 shows a partial view according to the line III—III in FIG. 1.

As can be seen in FIG. 2, the area of the permanent magnet 21'" is greater than the area of the electromagnet portion 21". This is so as to maintain the deflected sprung segment 19, which is attached to the magnets, in a position of interception with the tail 15", until the heal 15' of the elastic lowering needle 13, which passes inside the cam 17, is sufficiently covered by the raising cam 23.

While specific embodiments of the invention have been shown and described in detail to illustrate the application of the principles of the invention, it will be understood that the invention may be embodied otherwise without departing from such principles.

What is claimed is:

1. A device for a needle-by-needle selection in circular stocking knitting machines, comprising:

a cylinder with longitudinal grooves and a crown fixed to said cylinder;

a needle and a lower needle mounted in each said groove, said lower needle for raising said needle;

lower needle lowering and raising cams, each said lower needle having a lowering heel and a raising heel interacting with said lower needle lowering and raising cams, each said lower needle having an elastic rod which moves radially with respect to said cylinder due to mechanical deflection towards a bottom of said groove into an inoperative position, in which said lower needle remains inoperative, and said lower needle raising heel thereof does not interact with said raising cam and, due to an elasticity of said lower needle raising heel, said lower needle raising heel is urged towards the outside of said groove into an operating position, in which said raising heel thereof interacts with said raising cam, and in which the deflection of said lower needle is applied at the level of said raising heel thereof, and said lower needle ends at the bottom with a tail;

selector means arranged at the level of said tail of said lower needle, said selector means including:

a selector means elastic lock pin or elastic lock segment carried by said crown and oriented radially from a location outwardly of said cylinder towards said tail of said lower needle and positioned to be usually maintained in a position shifted downwards away from said tail;

a thruster arranged vertically under said lock segment, which can be moved upwards by means of thruster raising and lowering cams and is intended to lock said lower needle in the deflected, inoperative position when said thruster rises to deflect said lock segment up to the level of interception with said tail; and a selector means selection electromagnet that can be activated and deactivated according to a program, which is arranged above said lock segment and is intended to hold this segment in said position of interception with said tail of said lower needle, even if said thruster is moved towards the bottom, and to release said lock segment, because it returns downwards due to its own elasticity when said lower needle must be unlocked and moved towards the outside of said groove into the operating position.

2. The device in accordance with claim 1, further comprising a support means for said selection electromagnets, said support means being adjustable radially and being adjustable axially with respect to said cylinder.

3. The device in accordance with claim 1, wherein said selection electromagnet has a permanent magnet portion to hold said segment, which passes in an adjacent manner and an activatable/deactivatable portion to hold or to release said segment according to a program.

4. A device for a needle-by-needle selection in circular stocking knitting machines, comprising:

a cylinder with longitudinal grooves and a crown fixed to said cylinder;

a needle and a jack mounted in each said groove, said jack for raising said needle;

jack lowering and raising cams, each said jack has a lowering heel and a raising heel interacting with said jack lowering and raising cams, each said jack having an elastic rod which moves radially with respect to said cylinder due to mechanical deflection towards a bottom of said groove into an inoperative position, in which said jack remains inoperative, and said jack raising heel thereof does not interact with said raising cam and, due to an elasticity of said lower needle raising heel, said lower needle raising heel is urged towards the outside of said groove into an operating position, in which said raising heel thereof interacts with said raising cam, and in which the deflection of said jack is applied at the level of said raising heel thereof, and said jack ends at the bottom with a tail;

selector means arranged at the level of said tail of said jack, said selector means including:

a selector means elastic lock pin or elastic lock segment carried by said crown fixed with said cylinder, oriented radially from a location outwardly of said cylinder towards said tail of said jack and positioned to be usually maintained in a position shifted downwards away from said tail;

a thruster arranged vertically under said lock segment, which can be moved upwards by means of thruster raising and lowering cams and is intended to lock said jack in the deflected, inoperative position when said thruster rises to deflect said lock segment up to the level of interception with said tail; and a selector means selection electromagnet that can be activated and deactivated according to a program, which is arranged above said lock segment and is intended to hold this segment in said position of interception with said tail of said jack, even if said thruster is moved towards the bottom, and to release said lock segment, because it returns downwards due to its own elasticity when said jack must be unlocked and moved towards the outside of said groove into the operating position.

5. The device in accordance with claim 4, further comprising a support means for said selection electromagnets, said support means being adjustable radially and for a positioning in the upward direction with respect to said cylinder.

6. The device in accordance with claim 4, wherein said selection electromagnet has a permanent magnet portion to hold said segment, which passes in an adjacent manner and an activatable/deactivatable portion to hold or to release said segment according to a program.

* * * * *